United States Patent [19]

Ratchford et al.

[11] 4,421,373

[45] Dec. 20, 1983

[54] ELECTRICAL CONNECTOR HAVING MEANS FOR SEALING AGAINST MOISTURE

[75] Inventors: Lloyd G. Ratchford, Oneonta; Dee A. Werth, Afton, both of N.Y.

[73] Assignee: The Bendix Corporation, Southfield, Mich.

[21] Appl. No.: 334,869

[22] Filed: Dec. 28, 1981

[51] Int. Cl.[3] ..... H01R 13/52

[52] U.S. Cl. ..... 339/94 M; 339/45 M

[58] Field of Search ..... 339/94, 45

[56] References Cited

U.S. PATENT DOCUMENTS

| | | | |
|---|---|---|---|
| 1,790,292 | 1/1931 | Van Dorn | 339/94 M |
| 2,785,385 | 3/1957 | Figueira | 339/94 C |
| 3,458,850 | 7/1969 | Calisher | 339/45 M |
| 3,644,938 | 2/1972 | Slate | 339/94 R |
| 3,786,396 | 1/1974 | Kemmer et al. | 339/94 R |
| 3,976,352 | 8/1976 | Spinner | 339/94 R |
| 4,176,899 | 12/1979 | Betts | 339/45 M |
| 4,279,458 | 7/1981 | Knapp | 339/45 M |

*Primary Examiner*—Joseph H. McGlynn
*Assistant Examiner*—David L. Pirlot
*Attorney, Agent, or Firm*—Charles D. Lacina

[57] ABSTRACT

An electrical connector (20) having disposed around a rearward end portion (25) thereof a plurality of springs (36) in their respective spring cavities (39) and including an operating sleeve (40) circumposed therearound for movement rearwardly to a releasing position, a sealing adaptor (50) mounted to be connector and having a radial collar (56) positioned rearwardly of the cavities and a moisture seal (60) carried by the sleeve and having an inner portion (80) contacting the collar thereby moisture sealing a region around the springs and preventing ice formation in the cavities. The seal is generally V-shaped, with an outer portion (62) being carried in an annular recess (48) of sleeve (40).

5 Claims, 5 Drawing Figures

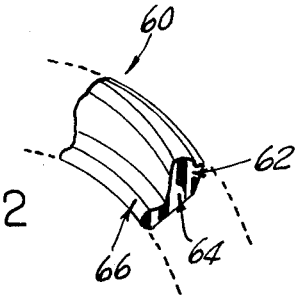
FIG. 2
FIG. 3
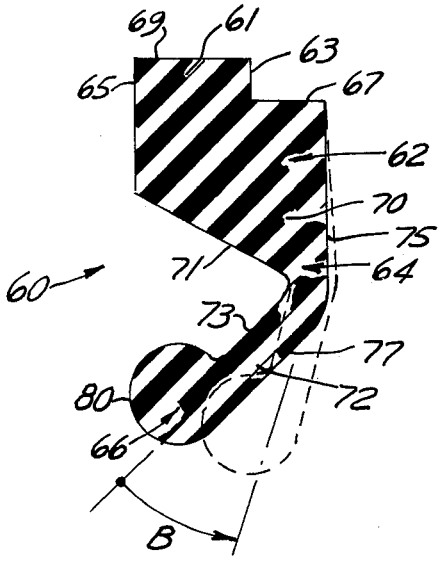
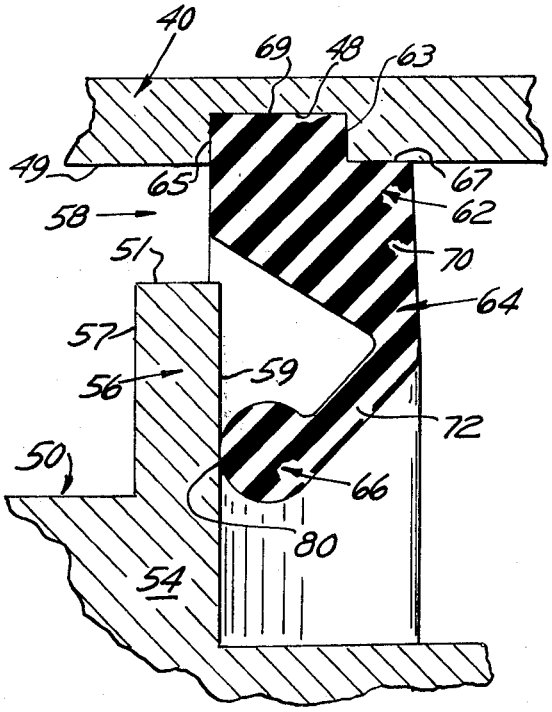
FIG. 4

ELECTRICAL CONNECTOR HAVING MEANS FOR SEALING AGAINST MOISTURE

This invention relates to an electrical connector having means for sealing against moisture.

A separable electrical connector assembly comprised of a plug connector, and a receptacle connector and means for coupling the connectors together is shown in U.S. Pat. No. 4,279,458 issuing July 21, 1981 and entitled "Releasing Electrical Connector", the specification and drawings of which are specifically incorporated herein by reference. Briefly the coupling means comprises a forward segmented housing and a rearward spring retainer circumposed around and the plug connector, a lanyard operated sleeve circumposed around mated assembly and several coil springs disposed within cavities of the spring retainer to bias the operating sleeve forwardly. In operation, a "releasing" force on the lanyard is transmitted from the operating sleeve to the receptacle connector, simultaneously causing the operating sleeve to be drawn axially rearwardly and away from the receptacle and the housing segments to "blossom" radially as a result of threads on each of the segments being cammed outwardly from engagement with threads on the receptacle connector. Because the operating sleeve moves axially rearwardly about the plug connector and the spring retainer, a rearward region surrounding the spring cavities is prone to air and moisture penetration.

In many environments, such as where both moisture and cold temperatures prevail, ice has a tendancy to form. A current but severe ice resistance test required by a United States Military Specification (MIL-C-38999H) imposes a requirement that a connector operate at −55° C. after being immersed in water. Should moisture be received in the cavities the springs turn to ice, a solid column of ice could form inside the cavities and around the spring coils and thereby prevent compression of the coil spring and/or adversely effect the releasing operation. The ice column, being relatively incompressible, would either frustrate releasability, increase the amount of lanyard force needed to crush the frozen matter or, in worst case, break the lanyard without achieving the desired release.

Potting boots are known for their utility in providing strain relief and moisture control. However, although self-contained, a region around a connection once "potted" is not releasable.

Accordingly, it would be desirable to provide a sealing arrangement for standard connector parts of a releasing electrical connector arrangement which is self-contained on one connector part, that easily adapts to presently available connectors and which effectively prevents moisture from entering an otherwise exposed rearward portion of a releasing electrical connector.

DISCLOSURE OF THE INVENTION

A releasing electrical connector having means for sealing against moisture, the connector assembly being provided with a coupling member including a spring biased operating sleeve carried by one of a pair of mated connectors and characterized by a sealing adaptor mounted to the one connector and including a radial collar therearound and a moisture seal of the surface-contact type that is ring shaped and sized to be snugly fit within an annular recess formed in the interior wall of the operating sleeve, the moisture seal being biased against the collar for sealing and axially moving with the operating sleeve during release, the moisture seal including an outer ring portion sized to seal the annular recess of the operating sleeve to which mounted, an inner ring portion adapted to act upon the radial collar and resilient V-shaped skirt that connects the inner and outer ring portions to moisture seal an otherwise exposed area between the coupling member and the one connector, the skirt pressuring the inner ring portion against the radial collar and forming a moisture seal when contact therewith.

One advantage of a surface-contact seal member is elimination of frictional forces, such as would be present in O-ring seals, that increase the minimum axial pull-separation force of the connector.

Another advantage of a surface-contact seal results in less wear, higher durability than O-ring seals and elimination of lubricants to reduce wear or friction on O-ring seals.

Yet a further advantage is the surface-contact seal will re-seal after pull-separation actuation.

Still a further advantage of this invention is elimination of potting boots.

DETAILED DESCRIPTION OF THE INVENTION

FIG. 2 shows a partial section cut from the moisture seal of FIG. 1 to show a radial section.

FIG. 3 shows the radial cross-section view of the moisture seal of FIG. 2.

FIG. 4 shows detail of the sealing relationship of FIG. 1.

Figure 1:
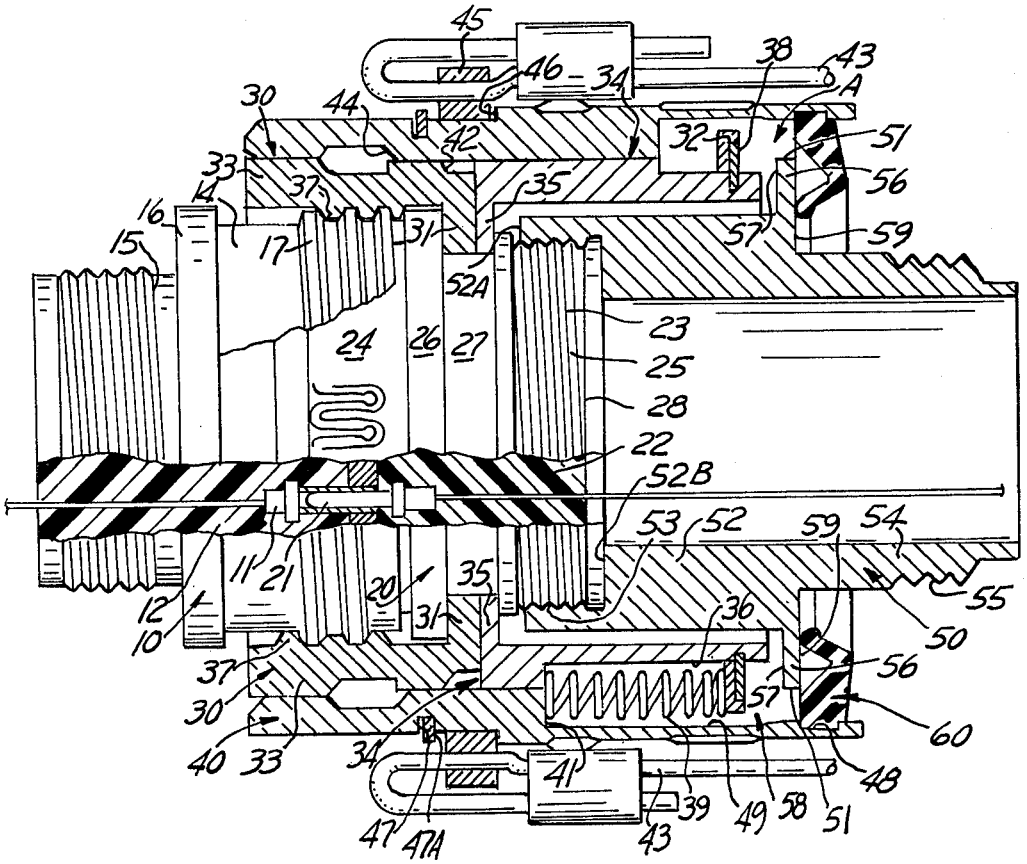
FIG. 1 shows, in partial longitudinal section, a releasing electrical connector having a moisture seal according to the present invention.
Figure 5:
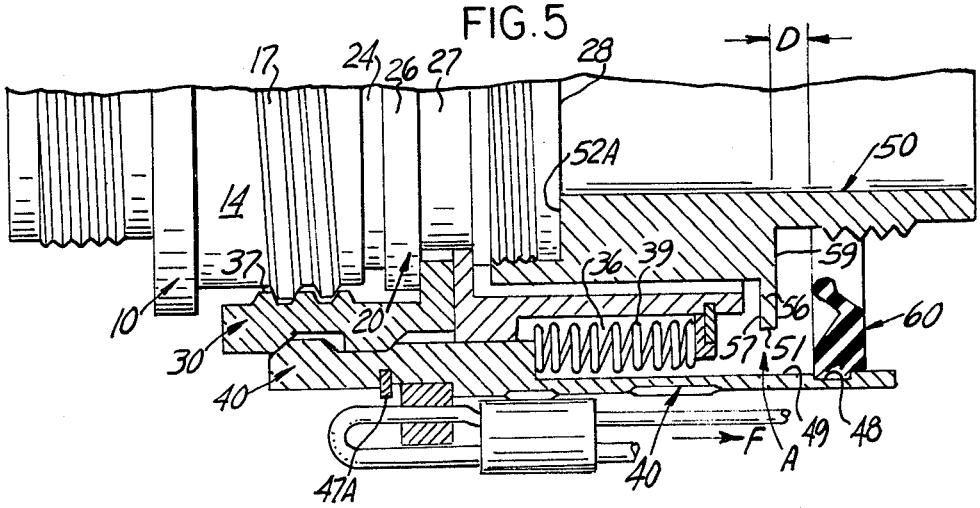

FIG. 5 illustrates a releasing position wherein the moisture seal axially separates from sealing contact with a radial collar of a sealing adaptor sleeve. Referring now to the drawings, FIG. 1 shows a releasing electrical connector 100 including a first connector member (i.e. a receptacle shell) 10 having a socket-type contact 11 mated with a pin-type contact 21 in a second connector member (i.e. a plug shell) 20, dielectric inserts 12, 22 supported in the shells for mounting the respective pin and socket contacts, means mounted to the plug shell and including an operating sleeve 40 for releasably coupling receptacle shell 10 to plug shell 20 and a moisture seal 60 operative between operating sleeve 40 and plug shell 20 for preventing moisture from entering therebetween. A duality of pin or socket contacts can be installed in either of the respective connector members.

Receptacle connector 10 includes a forward engaging end portion 14 having external thread 17, a rearward non-engaging end portion 15 and a radial flange 16 disposed medially between the receptacle end portions.

Plug connector 20 includes a forward engaging end portion 24 which telescopes within receptacle end portion 14 for mating, a rearward non-engaging end portion 25 having a rear end face 28, a radial flange 26 disposed medially between the plug end portions and an annular groove 27 adjacent radial flange 26 on non-engaging end portion 25.

The means for releasably coupling the plug and receptacle connector members are as shown in the aforementioned U.S. Pat. No. 4,279,458 and comprise several housing segments 30 with each having an inward radial flange 31 seated in annular groove 27 and a forward end 33 circumposed over forward engaging end portion 24 of plug shell 20; a spring retainer housing 34 having a plurality of longitudinally extending spring retainer cavities 36 and an inward radial flange 35 seated in annular groove 27 rearwardly of the radial flanges 31 of the segmented housings 30; a helical spring 39 disposed in each cavity; and the operating sleeve 40 having an interior wall 49 circumposed around the above assembly. Each helical spring 39 when positioned in its spring retainer cavity has a forward end which abuts a shoulder 41 of operating sleeve 40 and a rearward end which abuts a retaining ring 32 held in place on the spring retainer by a snap ring 38, the springs being adapted to normally bias operating sleeve 40 forwardly. Each housing segment 30 includes on an internal wall thereof thread 37 sized to engage external thread 17 on receptacle 10 and an exterior cam portion 42 configured to fit a like cam portion 44 on the interior wall 49 of operating sleeve 40. An annular shoulder 46 on operating sleeve 40 defines a stop for positioning a lanyard retaining ring 45 provided with a lanyard 43. Forwardly of annular shoulder 46 and in the exterior of operating sleeve 40 is an annular cavity 47A which is adapted to receive a snap ring 47 therein, snap ring 47 and annular shoulder 46 cooperating to captivate lanyard retaining ring 47 therebetween. Lanyard 43 transmits applied forces directly to the operating sleeve and plug shell 20 and thus to the threaded interconnection formed between segmented housings 30 and the receptacle shell 10, this force causing operating sleeve 40 to overcome the spring bias and move axially rearwardly and to cam the segmented housings radially outward (i.e. "blossom") from engagement with thread on the receptacle shell. The connector members are then released from their connection.

The rearward non-engaging end portion 25 of the plug shell is normally provided with thread 23 for receiving a potting boot (not shown) or other desired electrical connector apparatus.

Preferably and in accord with this invention a sealing adaptor 50 is provided. The sealing adaptor is generally cylindrical in shape and includes a forward end section 52 having a forward end face **52*a*, an interior wall provided with thread 53 for engaging thread 23 on the non-engaging end portion of plug shell 20 and an interior end face 52*b* rearwardly of thread 23, a rearward end section 54 having an exterior surface thereof circumposed by interior wall 49 of operating the sleeve 40 and provided with thread 55 for receiving further electrical connector apparatus, such as a strain relief sleeve or the like (not shown) and a radial collar 56 disposed between the ends of the sealing adaptor, the radial collar having a circumferential face 51, a forwardly directed end face 57 confronting the end face of spring retainer housing 34 and its associated spring cavities 36 and a rearwardly directed end face 59**, a portion of which being exposed to the environments.

Interior wall 49 of operating sleeve 40 extends axially rearwardly around sealing adapter 50 and includes therein annular recess 48. As such, an annular air space 58 exists locally between circumferential face 51 of radial collar 56 and interior wall 49 of the operating sleeve. This air space defines an annular opening which, if not sealed, would allow water to enter and ice to form in sping cavity 36.

Although interior end face **52*a* of sealing adaptor 50 is shown axially spaced apart to plug shell end face 28, when sealing adaptor 50 is mounted to plug shell 20, interior end face 52*a* will preferably compress against rearward end face 28 of plug shell 20 (see FIG. 5**).

FIG. 2 shows, partially in section, moisture seal 60. Preferably and in accord with the invention, moisture seal 60 is generally planar, ring shaped, molded into one piece from a resilient elastomeric material and includes an outer ring portion 62, an inner ring portion 66 and a V-shaped skirt 64 interconnecting the ring portions. The outer ring portion 62 is adapted to be mounted into annular recess 48 of operating sleeve 40 so as to position the inner ring portion 66 into biased contact with the exposed and rearwardly directed end face 59 of radial collar 56, the moisture seal being sized to cover air space 58 between the circumferential face of radial collar 50 and the inner wall of operating sleeve 40.

FIG. 3 shows moisture seal 60 in section and comprises outer ring portion 62 including a shoulder 61 defining oppositely disposed first and second abutment faces 63, 65 and inner and outer circumferential faces 67, 69, the radial shoulder 61 being sized for a snug squeeze fit within the annular recess 48, such fitment causing the inner circumferential face 67 to compress against inner wall 49 of operating sleeve 40, the outer circumferential face 69 to compress against the circumferential wall of annular recess 48 and the two abutment faces 63, 65 to compress against the interior axial walls of recess 48, resulting in interior wall 49 of operating sleeve 40 being protected against moisture penetration. Skirt 64 includes first and second skirt portions 70, 72 with the first skirt portion 70 extending inwardly from its connection to outer ring portion 62 and having first and second faces 71, 75 and the second skirt portion 72 extending outwardly from its connection to inner ring portion 66 and having first and second faces 73, 77, the first and second skirt portion extensions being connected where they intersect. The skirt portions form a V-shape between their first faces 71, 73 where they meet an acute angle. Inner ring portion 66, disposed at the remote end of second skirt portion 72, is generally round and bulb-like with a surface portion 80 thereof being adapted to contact radial collar 56 of sealing adaptor 50. The first and secondd skirt portions 70, 72 are of decreeasing thickness to provide skirt 64 with suitable resilience. First skirt portion 70 is substantially rigid relative to second skirt portion 72 so as to undergo a small deflection when the inner portion 66 contacts radial collar 56.

Preferably, the elastomer would be an acellular silicone of durometer 60–80, with Durometer 70 being a suitable compromise providing adequate stiffness yet resist deterioration from moisture and ice. The dashed lines indicate that skirt portions 70, 72 deform an angle "B" as a result of surface 80 being compressed against radial collar 56. A skirt deflection angle "B" of 1–5°, when sealing, would be suitable.

FIG. 4 shows rearward end section 54 of sealing adaptor 50 with radial collar 56 being contacted on its rearward face 59 by surface 80 of the bulb-like inner ring portion 66 and second skirt portion 72 being folded slightly rearwardly relative to the radial collar as surface 80 is carried forwardly on the operating sleeve and compressed against the radial collar.

FIG. 5 shows the result of an axial force "F" on lanyard 43, a force of intensity sufficient to overcome spring bias and thus to separate plug shell 20 from receptacle shell 10. As shown, moisture seal 60 has axially separated a distance "D" from its sealing contact with radial collar 56. An area "A" is now exposed since the seal is carried by the sleeve for rigid body movement rearwardly of the sealing adaptor collar.

While a preferred embodiment of this invention has been disclosed, it will be apparent to those skilled in the art, the changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

I claim:

1. An electrical connector having means for sealing against moisture, the electrical connector of the type including a pair of electrical connector members (10, 20) having their forward end portions (14, 24) mated; a duality of electrical contacts (11, 21) carried by said connectors and forming an electrical interconnection in the mated connectors; means (40, 30, 35, 37, 17) for releasably coupling the connector members, the releasable coupling means being carried by one connector member for connection to the other connector member and including a sleeve (40) having an interior wall (49) circumposed about a spring retainer (35) and mounted for movement rearwardly of said forward end portions; and means (39) disposed in the retainer for resisting rearward movement of the sleeve and for normally biasing the sleeve forwardly, the means for sealing against moisture characterized by:

said sleeve (40) having an annular recess (48) circumposed around the interior wall (49);

a sealing adapter (50) mounted to said one connector member and including a radial collar (56) defining oppositely disposed first and second end faces (57, 59); and a moisture seal (60) carried by the sleeve (40), said mositure seal comprising an outer ring portion (62) sized to fit the annular recess (48), an inner ring portion (66) adapted to contact and seal about the radial collar (56) and a resilient skirt (64) interconnecting said ring portions (62, 66), said skirt (64) including first and second skirt portions (70, 72) with said first skirt portion (70) extending from its connection to the outer ring portion (62) and said second skirt portion (72) extending from its connection to the inner ring portion (66).

2. The electrical connector as recited in claim 1 wherein said inner ring portion (66) comprises a rounded bulb-like enlargement and said skirt portion (70, 72) intersect to form a V-shape in cross-section.

3. The electrical connector as recited in claim 1 wherein said moisture seal (60) is comprised of an acellular silicone having a Durometer 60–80.

4. The electrical connector as recited in claim 1 wherein said first skirt portion (70) is substantially rigid relative to said second skirt portion (72) so as to permit the second skirt portion (72) to undergo a small deflection when the inner ring portion (66) contacts the collar (56).

5. The electrical connector as recited in claim 4 wherein said second skirt portion (72) undergoes a deflection of between 1°–5°.

* * * * *